United States Patent [19]

Shultz

[11] Patent Number: 4,802,389

[45] Date of Patent: Feb. 7, 1989

[54] ADJUSTABLE WORKPIECE GRIPPING AND ROTATING DEVICE

[76] Inventor: William E. Shultz, 239 N. Main St., Lombard, Ill. 60148

[21] Appl. No.: 687,659

[22] Filed: Dec. 31, 1984

Related U.S. Application Data

[63] Continuation of Ser. No. 463,858, Feb. 4, 1983, abandoned.

[51] Int. Cl.[4] ..... B25B 13/12

[52] U.S. Cl. ..... 81/127; 81/133

[58] Field of Search ..... 81/90 B, 127, 133, DIG. 8, 81/165, 170

[56] References Cited

U.S. PATENT DOCUMENTS

| | | | |
|---|---|---|---|
| 1,133,236 | 3/1915 | Peterson | 81/170 X |
| 1,745,224 | 1/1930 | Magner | 81/133 |
| 2,778,260 | 1/1957 | Jovanovich | 81/127 |
| 2,970,502 | 2/1961 | Norogren | 81/165 X |
| 3,063,315 | 11/1962 | Bernor et al. | 81/90 B |
| 3,603,181 | 9/1971 | Shultz | 81/90 C |

FOREIGN PATENT DOCUMENTS

| | | | |
|---|---|---|---|
| 371346 | 3/1923 | Fed. Rep. of Germany | 81/133 |
| 618203 | 2/1949 | United Kingdom | 81/DIG. 8 |

*Primary Examiner*—James G. Smith

*Attorney, Agent, or Firm*—Mason, Kolehmainen, Rathburn & Wyss

[57] ABSTRACT

Disclosed is a new and improved device for gripping and rotating a workpiece. The device includes an adjustable jaw, adjustable through a rack and pinion gear assembly so that torque applied to the gear member, for example by connecting the gear to a cooperatively fitting ratchet wrench drive handle, causes simultaneous jaw tightening and rotation of the device to achieve rotation of the workpiece without jaw slippage.

6 Claims, 2 Drawing Sheets

ADJUSTABLE WORKPIECE GRIPPING AND ROTATING DEVICE

CROSS REFERENCE TO RELATED APPLICATION

This is a continuation of application of copending patent application Ser. No. 463,858, filed Feb. 4, 1983 now abandoned.

FIELD OF THE INVENTION

The present invention relates to adjustable clamping jaws and more particularly to adjustable wrench clamping jaws capable of simultaneous tightening and rotation through a gear member so that attachment of a ratchet wrench drive assembly or other elongated gear rotating means to the gear member tightens the clamping jaws and, after complete tightening of the jaws, further rotation of the gear member by the gear rotating means causes rotation of the clamping jaws while simultaneously assuring a tenacious grip of the jaws on a workpiece. The clamping jaws of the present invention can be in any desired form, for example, tie rod clamping jaws, pipe wrench jaws, hexagonal jaws, square jaws, and the like.

BACKGROUND OF THE INVENTION AND PRIOR ART

Probably the best known type of adjustable wrench is known as the CRESCENT wrench, manufactured by the Cresent Tool Co. of Jamestown, N.Y. The CRESCENT wrench includes a fixed jaw forming an integral part of the wrench handle, and an adjustable jaw disposed below the fixed jaw and adjustably connected to the wrench by an interconnected rack and gear mechanism to raise and lower the adjustable jaw by rotation of the gear. Even the occasional mechanic who has used the typical, presently existing adjustable wrenches has experienced major drawbacks to the adjustable wrench. Because of an imperfect connection between the rack and gear mechanism, the adjustable jaw of the adjustable wrench has some slop or play inherent in each setting. Once the lower jaw is tightened around the workpiece in an attempt to eliminate any downward movement of the adjustable lower jaw upon turning of the wrench handle, generally it is found that the lower jaw has some rotational movement upon wrench handle turning eventually causing an imprecise fit of the jaws around the workpiece and sometimes causing stripping or rounding of the flat wrench engaging surfaces of the workpiece. Further, often it is necessary to loosen the gear setting to remove the adjustable wrench from the workpiece when in close quarters where 360° rotation is not possible so that the wrench has to be removed and repositioned for further tightening or loosening of the workpiece. Because of these drawbacks, the skilled mechanic utilizes wrenches having fixed workpiece engaging jaws whenever available and, more particularly prefers fixed jaws attachable to a ratchet drive handle when in close quarters so that wrench removal and re-positioning is not necessary for complete tightening and loosening of the workpiece.

The following patents disclose a clamping member attached to an adjustable wrench in an attempt to eliminate the play between rack and gear to provide a positive locking of the wrench jaws and eliminate accidental wrench slippage: Siegrist U.S. Pat. No. 1,866,426; Brady U.S. Pat. No. 1,877,642; Justice U.S. Pat. No. 2,069,582; Michalka U.S. Pat. No. 2,160,977; Bachli et al. U.S. Pat. No. 2,979,977; Popper et al. U.S. Pat. No. 3,251,251, Schrader U.S. Pat. No. 3,340,753; and Hudson U.S. Pat. No. 4,094,215.

The Romak U.S. Pat. No. 3,766,810 eliminates the rack and gear assembly and provides a simple threaded bolt tightened into a threaded female aperture in one jaw to eliminate slop or play in jaw positioning around the workpiece, in a device for rotating a slotted sleeve in a tie rod assembly. Further, to eliminate the necessity for removing and repositioning the device when in close quarters, the four corners of the Romak device are provided with welded nuts for attachment to a standard open ended wrench. One problem with the Romak device is that the jaw tightening bolt first must be tightened to secure the jaws of the device in position securely engaging the workpiece and then the wrench must be removed from the bolt and re-positioned on the corner welded nuts for turning the device. It is very time consuming to first completely tighten the bolt to secure the jaws into position and to completely loosen the bolt to remove the device. Also, if the Romak device is left on the tie rod assembly, it may interfere with the vehicle's turning ability and will not fall off of the vehicle. Another problem with the Romak device is that the initial bolt tightening to secure the jaws in position on the tie rod sleeve causes pinching of the sleeve against the internal threaded rod, thus interferring with initial sleeve spreading and penetration of penetrating oil or other thread loosening composition. Further, the Romak bolt is capable of slipping out of an enlarged slot in one jaw if extreme torque is needed to begin turning the workpiece.

The device of the present invention eliminates all of the above-described disadvantages in adjustable wrenches by providing a tool or device having an adjustable jaw capable of both tightening and jaw rotation by rotation of a gear member. Torque is applied to the jaws and therefore the workpiece from torque applied to the gear member to achieve simultaneous jaw tightening and jaw rotation thereby assuring the most tenacious jaw gripping onto the workpiece when the most torque is applied to tighten or loosen the workpiece. In accordance with an important feature, when most torque is applied to the device of the present invention to initially loosen the workpiece, the device most tenaciously grips the workpiece to avoid slippage.

UMMARY OF THE INVENTION

In brief, the present invention is directed to a new and improved device for gripping a workpiece having an adjustable jaw, adjustable through a rack and pinion gear assembly so that torque applied to the gear member, for example by connecting the gear to a cooperatively fitting ratchet wrench drive handle, causes simultaneous jaw tightening and rotation of the device to achieve rotation of the workpiece without jaw slippage. Torque is applied to the gear member achieving mechanical advantage through a rack and gear assembly to obtain extreme tightening of the adjustable jaw around the workpiece, particularly during initial loosening and final tightening of the workpiece.

Accordingly, an object of the present invention is to provide a new and improved device for tenacious gripping and rotation of a workpiece.

Another object of the present invention is to provide an adjustable wrench device capable of manual initial adjustment onto a workpiece by finger force applied directly to a moveable jaw member.

Still another object of the present invention is to provide a new and improved device for rotation of a workpiece having an adjustable workpiece engaging jaw and a fixed workpiece engaging support surface or fixed jaw wherein the adjustable jaw is moveable with respect to the support surface through a rack and pinion and the pinion is adapted to be engaged by an elongated handle for applying torque to the pinion to cause jaw tightening and rotation of the device.

Another object of the present invention is to provide a new and improved adjustable wrench adjustable through a rack and pinion gear mechanism wherein the pinion frictionally engages pinion supporting surfaces of the device to prevent inadvertent jaw separation but can be rotated by manual force applied to an adjustable jaw for initial positioning of the wrench jaws to surround a workpiece.

These and other objects and advantages of the invention will be apparent from the following description of the invention in connection with the drawings in which:

FIG. 6 is an exploded, perspective view of the apparatus of FIG. 1;

DETAILED DESCRIPTION OF THE PREFERRED EMBODIMENT

Figure 1:
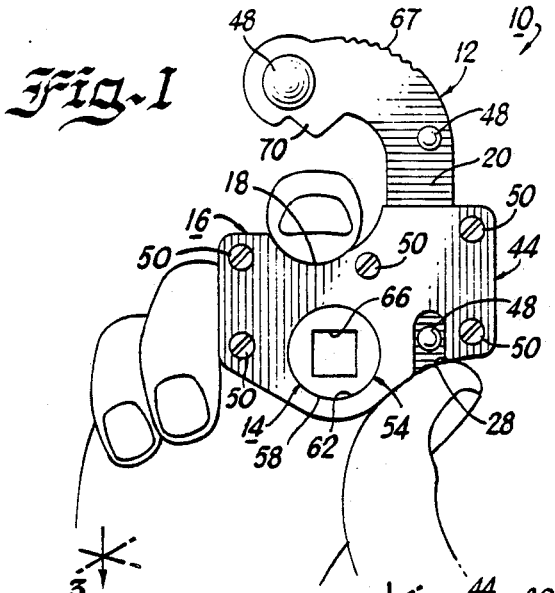
FIG. 1 is a side view of one embodiment of the apparatus of the present invention showing manual expansion of the adjustable jaw for initial positioning of the device around a workpiece.

Referring to FIGS. 1 and 6, the apparatus of the present invention, designated generally by reference numeral 10, includes an adjustable jaw member 12, a pinion or annular gear member designated generally by reference numeral 14, a gear mechansim housing designated generally by reference numeral 16, and a fixed lower workpiece support surface or fixed jaw member 18 formed integrally with the gear mechanism housing 16. Elongated rack 20 extending from and integral with the adjustable jaw member 12, includes slots 22 defining teeth members 24 therebetween. The rack portion 20 of the adjustable jaw member 12 is movably received within a vertical slot 26 (see FIG. 4) disposed within the gear mechanism housing 16 and the vertical slot 26 extends completely through the gear mechanism housing 16 so that a lowermost knurled end 28 of the adjustable jaw member 12 can be manually pushed upwardly to raise the adjustable jaw member 12, as shown in FIG. 1, to initially separate the adjustable jaw member 12 from the lower work piece support surface or fixed jaw member 18 for initial positioning of the device around a workpiece.

The vertical slot 26 in which the adjustable jaw member 12 is moveably disposed is defined on a jaw front surface by an inner stop member 30 forming a jaw front stop wall or surface 32, and defined by a rear stop member 34 having a jaw rear stop wall or surface 36. The jaw front and rear stop walls or surfaces 32 and 36 are slightly wider than the width "W" of the adjustable jaw member 12 (FIG. 6) to permit vertical movement of the adjustable jaw member 12 upon manual force applied to the adjustable jaw member 12, such as shown in FIG. 1. The slot 26 is further defined by side jaw stop wall surfaces 38 and 40 being inner surfaces of end plates 42 and 44 of the gear mechanism housing 16 forming jaw alignment or stop surfaces, to define the slot 26. As shown best in FIG. 6, the front and rear jaw stop walls 32 and 34 together with the side jaw stop walls 38 and 40 define the elongated, channel or slot 26 extending completely through the housing 16. The gear mechanism housing 16, as well as the front and rear stop members 30 and 34 preferably are made of laminated steel plates 45 to provide a device of extremely strong construction having good structural support for the adjustable jaw member 12 and lower workpiece support surface or fixed jaw member 18. Similarly, the adjustable jaw member 12 can be formed from a plurality of hardened steel plates 46 secured together in any suitable manner such as by rivets or bolts 48. The housing end plates 42 and 44 and the stop members 30 and 34 are secured together such as by rivets, or bolts 50 threaded into threaded bolt receiving apertures 51 in end plate 42, as shown in FIG. 6.

Figure 4:
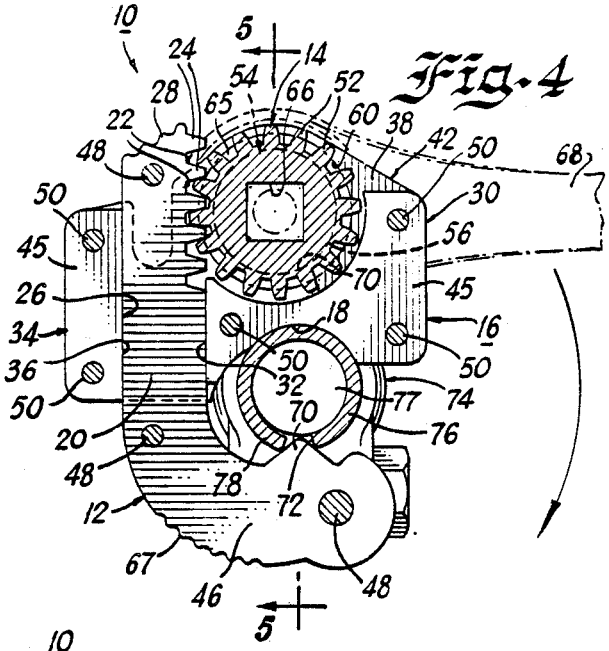
FIG. 4 is a side view taken along the line 4—4 of FIG. 2 showing ratchet rotation causing spreading of the tie rod slotted sleeve, jaw tightening and rotation of the device.
Figure 2:
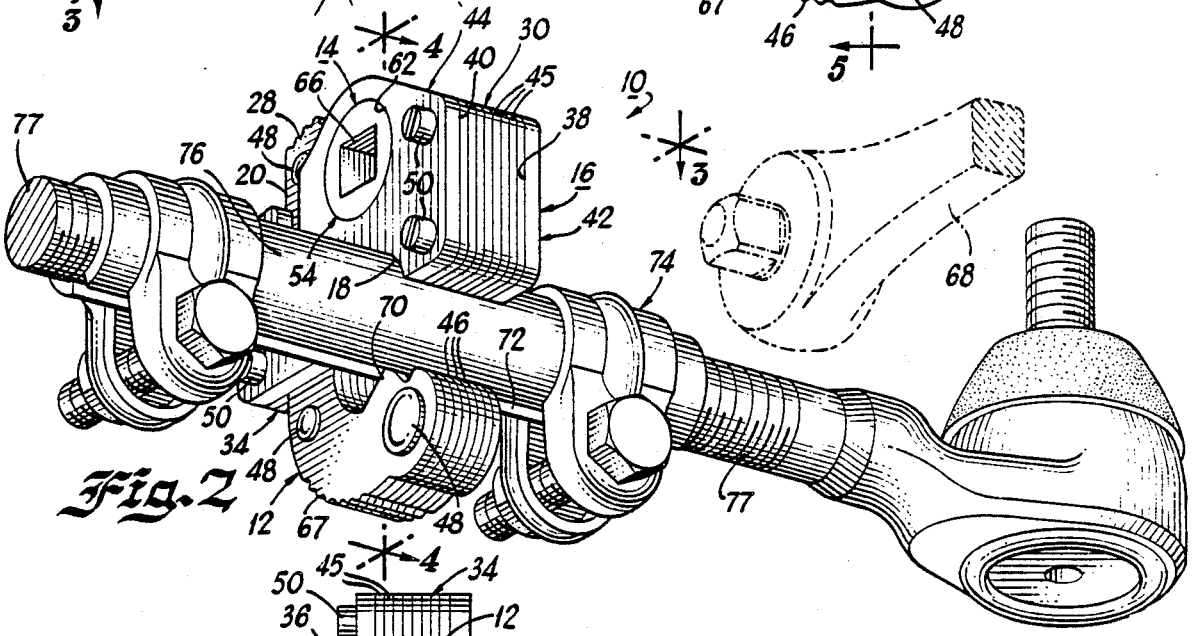
FIG. 2 is a perspective view of the apparatus of FIG. 1 showing the device attached to a slotted sleeve of a vehicle tie rod assembly.
Figure 3:
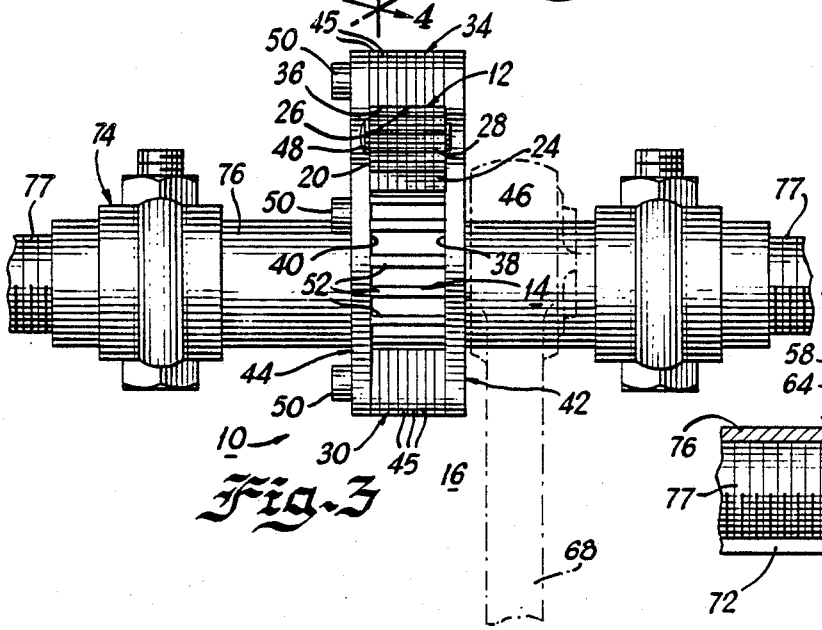
FIG. 3 is an end view taken along the line 3—3 of FIG. 2 showing a ratchet wrench drive handle attached to the pinion.
Figure 5:
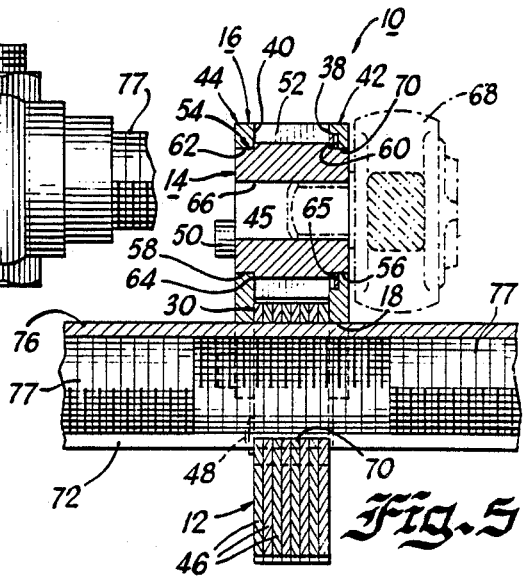
FIG. 5 is an end view taken along the line 5—5 of FIG. 4.
Figure 5:
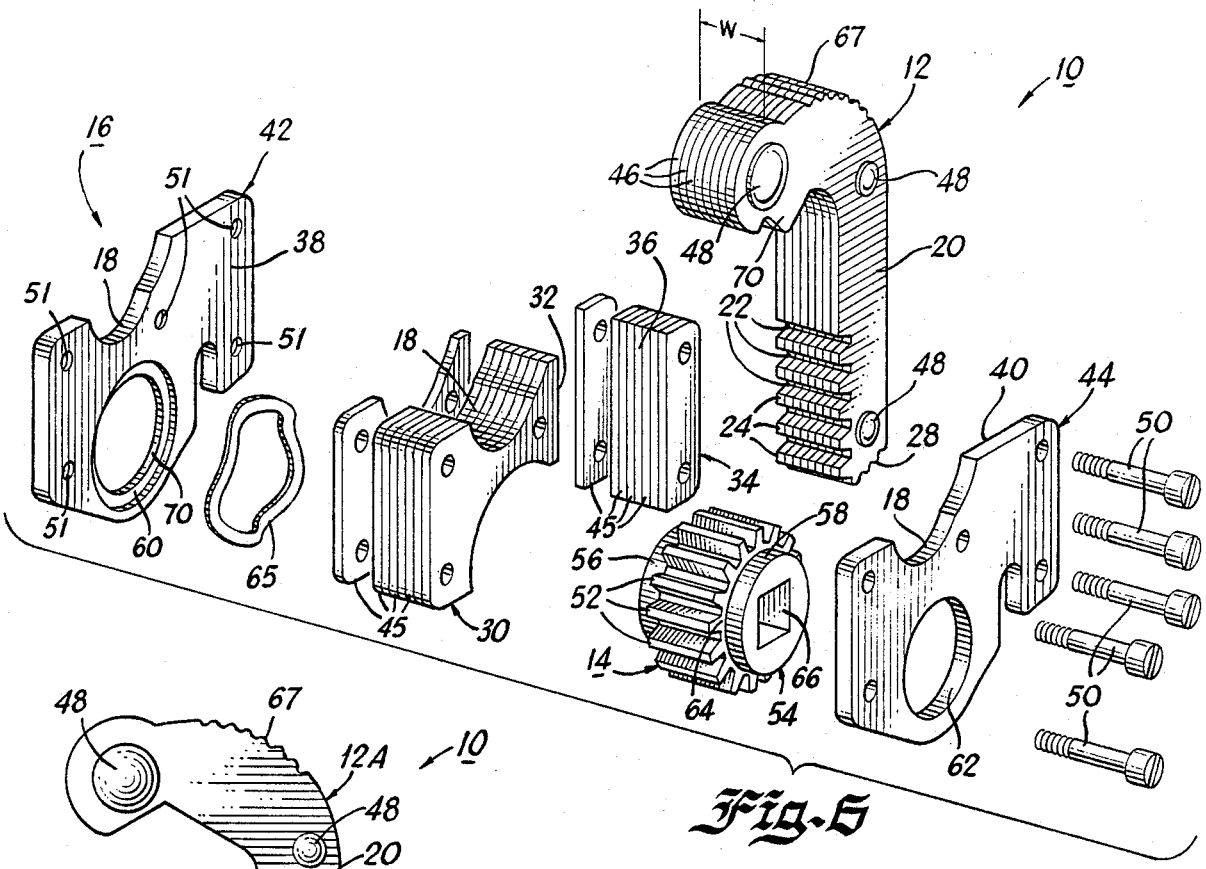

In accordance with an important feature of the present invention, the pinion or annular gear, designated generally by reference numeral 14 includes a plurality of radially extending teeth 52 cooperatively shaped with the slots 22 in the rack 20 portion of the adjustable jaw member 12. The teeth 52 of the pinion 14 extend within the adjustable jaw channel or slot 27 to positively engage the slots 22 in the adjustable jaw member 12 so that rotation of pinion 14 causes vertical upward or downward movement of the adjustable jaw member 12, as best shown in FIG. 4.

In the preferred embodiment shown in the drawings, the pinion 14 is a single, integral part including the radially extending teeth 52 and a centrally disposed integral axle 54. The axle 54 extends axially beyond the teeth 52 to provide rotatable annular support or bearing surfaces 56 and 58 (FIG. 6). Support or bearing surface 56 on the axle 54 is rotatably received within an annular slot 60 in gear housing end plate 42 and annular axle support or bearing surface 58 is rotatably received within annular aperture 62 in gear housing end plate 44 so that the pinion 54 can rotate within slot 60 and end plate aperture 62 as the axle 54 is turned. Side surfaces 64 of the radially extending teeth 52 act as a stop against the inner surface 40 of the end plate 44 on gear mechanism housing 16 to secure the pinion 14 within the gear mechanism housing 16.

In accordance with another important feature of the present invention, the pinion 14 includes a longitudinally extending and centrally disposed slot or channel 66 for pinion rotating engagement by any complimentary shaped elongated rotating means or torque applying member such as a ⅜ inch or ½ inch ratchet wrench drive handle 68, shown in phantom lines in FIGS. 2–5 and 7. It is understood that the channel 66 can be formed of any desired shape to fit any torque applying member of a complimentary shape to achieve a sturdy, positive interlocking of the torque applying member to the pinion 14.

In accordance with an important feature of the present invention, the elongated channel 66 extends axially completely through the axle 54 of pinion 14 so that the elongated channel 66 can be positively engaged for rotation by the ratchet drive handle 68 from either side - from the annular aperture 62 in one end plate 44 or through an annular aperture 70 in the other end plate 42. In close quarters, the pinion 14 can be engaged for rotation by a torque applying member, such as ratchet drive handle 68, from either side of the pinion 14. Rotation of the pinion 14 in a clockwise direction, as indicated by the arrow on pinion 14 in FIG. 1, will move the adjustable jaw member 12 closer to the workpiece support or fixed jaw surface 18 for locking the jaw members onto a workpiece and, once the jaw members the locked onto the workpiece, further clockwise rotation of the pinion 14 will cause rotation of the entire apparatus 10 for tightening of the workpiece. It is understood that the device 10 is operable only when the pinion 14 is rotated in a direction to tighten the adjustable jaw toward the workpiece support surface 18 so that the workpiece can be simultaneously gripped and rotated (clockwise as the deivce is shown in FIG. 1). The device 10 can be positioned with the jaw opening on one side or the other of the workpiece so that rotation of the pinion 14 in a direction to tighten the adjustable jaw 12 will rotate the workpiece in either a clockwise or a counterclockwise direction to achieve tightening or loosening of the workpiece.

In accordance with an important feature of the present invention, a wave washer 65 is disposed within the slot 60 in end plate 42 for frictional engagement against an end surface of the axle portion 54 of pinion 14 so that the adjustable jaw member 12 will remain in a desired position engaging a workpiece when the adjustable jaw member 12 is initially manually closed to engage the workpiece. The adjustable jaw member 12 includes a knurled top surface 67 for manually pushing the adjustable jaw member against a workpiece. The frictional engagement of wave washer 65 against the pinion is sufficient to prevent the adjustable jaw member 12 from slipping out of position once manually closed onto a workpiece, but not so great as to make it difficult for the typical user to manually set the jaw 12 into a position engaging the workpiece.

In accordance with an important feature of the present invention, the adjustable jaw 12 can be initially manually closed to grip the workpiece between adjustable jaw 12 and workpiece support surface 18, to provide any needed spacing between adjustable jaw 12 and support surface 18. Since the wave washer 65 provides frictional engagement or rotational resistance against the pinion 14 at all times, the pinion 14 can be initially set to provide any desired jaw spacing while applying sufficient rotational resistance to the pinion 14 to prevent jaw slippage once the jaws are initially, manually secured to the workpiece.

This pinion rotational resistance over the full 360° of rotation, therefore, is much more advantageous than, for example, a typical detent which allows for resistance only at incremental points along a rotational path. The wave washer 65, or other rotational resistance to rotation of the pinion 14 along its entire rotational path permits the jaws to be initially set at any jaw spacing without slippage so that the mechanic can initially secure the device to the workpiece and then have both hands free to locate and interlock a ratchet drive handle 68 to the pinion 14.

In accordance with one embodiment of the present invention shown in FIGS. 1–6, the adjustable jaw member 12 includes a wedge shaped integral workpiece engaging extension member 70 for engaging and spreading an elongated slot 72 of a vehicle wheel tie rod assembly, designated generally by reference numeral 74. The fixed jaw member surface 18, in this embodiment, is a rounded or annular surface to accommodate a sleeve portion 76 of the vehicle wheel tie rod assembly 74.

As best shown in FIG. 4, the device 10 having extending wedge portion 70 for tuning interlocking within slot 72 of the slotted sleeve 76 of a tie rod assembly 74 is much more advantageous than a device like that of the Romak U.S. Pat. No. 3,766,810 since the threaded internal rod 77 is not pinched by the device of the present invention and, therefore, the device is capable of lifting an elongated edge 78 of the slotted sleeve 76, when the device is rotated, to permit penetrating of a lubricant, such as penetrating oil, between the sleeve 76 and the internal threaded rod 77. By rotating the pinion 14, the lever arm between the pinion axis and the rack 20 of adjustable jaw 12 provides an advantageous mechanical advantage for exerting tremendous pressures in lifting the elongated edge 78 of slotted sleeve 76 for lubricant penetration around the threads of rod 77 and initial loosening of the sleeve 76, which oftentimes is initially sealed to the threaded rod 77 because of rusting.

Figure 7:
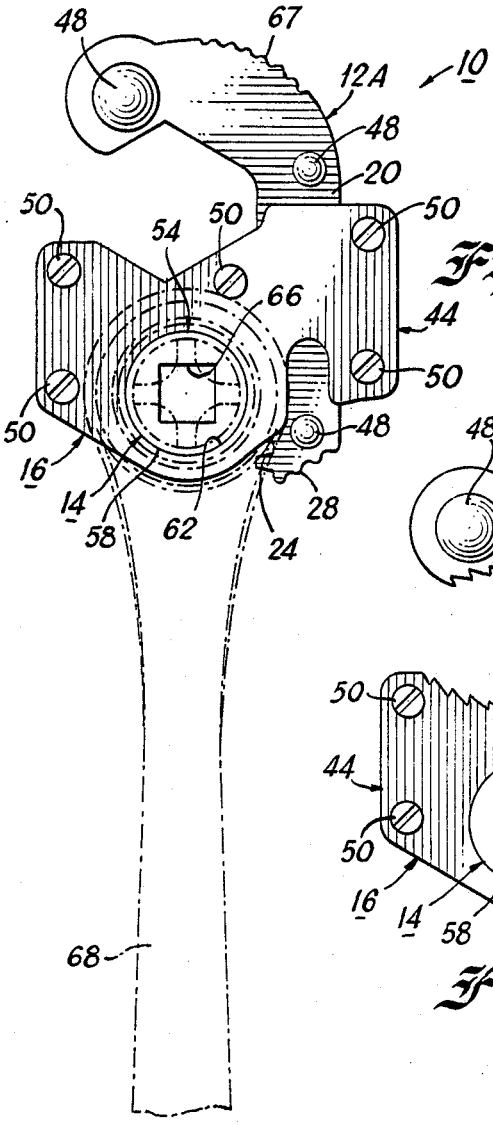
FIG. 7 is a side view of another embodiment of the apparatus of the present invention showing jaws in hex-form.
Figure 8:
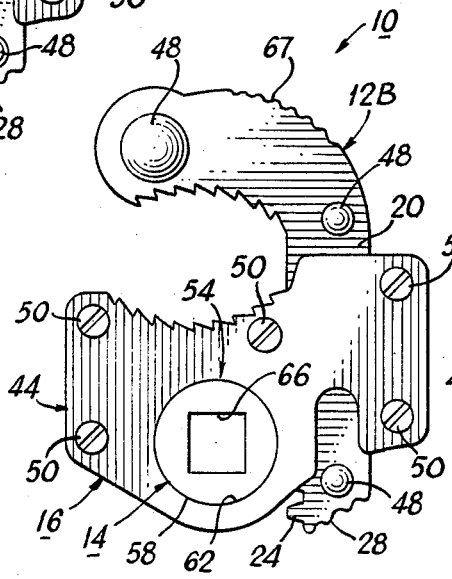
FIG. 8 is a side view of another embodiment of the apparatus of the present invention showing jaws in pipe wrenchform.
Figure 9:
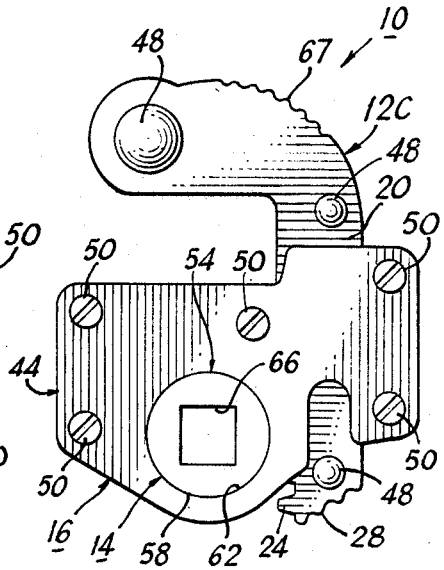
FIG. 9 is a side view of another embodiment of the apparatus of the present invention showing jaws in square or rectangular form.

Three other embodiments of the present invention are shown in FIG. 7, 8 and 9 wherein the adjustable and fixed jaw members 12 and 18 are shaped in the form of a hex-wrench 12A, pipe wrench 12B, and square or open end wrench, respectively. It is to be understood that the jaws of the device of the present invention can be manufactured having any desired shape or form to provide positive engagement on a workpiece having any configuration.

I claim:

1. Apparatus for gripping and rotating a workpiece comprising:

a gear mechanism housing having therein a rotatable annular gar member rotatably secured within the housing, said gear member including a plurality of radially extending teeth extending from an integral axle said axle including integral bearing surfaces on opposite ends, said gear member axle including a torque member-receiving slot extending completely through the axle and the housing to permit a torque member to engage the gear member axle from opposite sides of the housing;

a first adjustable jaw member including an integral elongated rack having a plurality of teeth cooperatively spaced to be received between the teeth of the annular gear member, said rack received and movable within a rack-receiving slot in the gear mechanism housing, said rack-receiving slot extending completely through the gear mechanism housing so that the adjustable jaw member can be manually forced to achieve more or less jaw separation, said slot defined by spaced inner housing wall members to maintain said gear member in alignment with said rack to maintain interengagement of the teeth of the rack with the teeth of the gear member;

a second jaw member integral with the gear mechanism housing, cooperatively disposed with respect to the adjustable jaw member for gripping a workpiece therebetween;

friction means disposed between said gear member and said gear member housing for frictionally engaging said gear member to provide a predetermined rotational resistance to said gear member at all rotational positions of said gear member, so that the adjustable jaw member and gear member are manually movable to manually initially set and maintain the adjustable jaw member with respect to the second jaw member onto a workpiece to any approximate, predetermined desired spacing without further movement or slippage of said adjustable jaw member from said predetermined initial spacing.

2. The apparatus of claim 1 including a torque applying means comprising an elongated handle engageable with and disengageable from said gear member from either of said opposite housing sides such that rotation of said handle applies torque to said gear member to rotate said gear member in either direction to the extent that the handle is rotated.

3. Apparatus of claim 1 wherein said gear member is a pinion gear.

4. The apparatus of claim 1 wherein said means for frictionally engaging the gear member comprises a wave spring.

5. The apparatus of claim 4 wherein the gear mechanism housing includes an annular slot for receiving the wave spring to maintain contact of said wave spring against said gear member to provide constant rotational resistance to said gear member.

6. A method of rotating a workpiece with a workpiece rotating device wherein said device includes:

a gear mechanism housing having therein a rotatable annular gear member rotatably secured within the housing, said gear member including a plurality of radially extending teeth extending from an integral axle said axle including integral bearing surfaces on opposite ends, said gear member axle including a torque member-receiving slot extending completely through the axle and the housing to permit a torque member to engage the gear member axle from opposite sides of the housing;

a first adjustable jaw member including an integral elongated rack having a plurality of teeth cooperatively spaced to be received between the teeth of the annular gear member, said rack received and movable within a rack-receiving slot in the gear mechanism housing, said rack-receiving slot defined by spaced inner housing wall members to maintain said gear member in alignment with said rack to maintain interengagement of the teeth of the rack with the teeth of the gear member;

a second jaw member; cooperatively disposed with respect to the adjustable jaw member for gripping a workpiece therebetween;

friction means disposed between said gear member and said gear mechanism housing for frictionally engaging said gear member to provide a predetermined rotational resistance to said gear member at all rotational positions of said gear member, so that the adjustable jaw mechanism and gear member are manually movable to manually initially set and maintain the adjustable jaw member with respect to the second jaw member onto a workpiece to any approximate, predetermined desired spacing without further movement or slipapge of said adjustable jaw member from said predetermined initial spacing;

said method including initially manually setting the adjustable jaw member onto said workpiece to loosely grip said workpiece between the jaw members;

connecting an elongated handle to the gear member;

rotating the elongated handle and gear member to grip said jaw members tightly onto said workpiece; and further rotating said elongated handle and gear member to apply torque to said gear member and to said adjustable jaw member to maintain tight contact of said jaw members on said workpiece and to rotate said workpiece.

* * * * *